US011779049B2

(12) United States Patent
Bowen et al.

(10) Patent No.: US 11,779,049 B2
(45) **Date of Patent: *Oct. 10, 2023**

(54) MULTIPLE HEATING ELEMENTS WITH SEPARATE VAPORIZABLE MATERIALS IN AN ELECTRIC VAPORIZATION DEVICE

(71) Applicant: Juul Labs, Inc., San Francisco, CA (US)

(72) Inventors: Adam Bowen, San Mateo, CA (US); James Monsees, San Francisco, CA (US)

(73) Assignee: Juul Labs, Inc., San Francisco, CA (US)

( * ) Notice: Subject to any disclaimer, the term of this patent is extended or adjusted under 35 U.S.C. 154(b) by 590 days.

This patent is subject to a terminal disclaimer.

(21) Appl. No.: 16/877,043

(22) Filed: May 18, 2020

(65) Prior Publication Data

US 2020/0275693 A1 Sep. 3, 2020

Related U.S. Application Data

(63) Continuation of application No. 14/304,847, filed on Jun. 13, 2014, now Pat. No. 10,653,180.

(60) Provisional application No. 61/835,458, filed on Jun. 14, 2013.

(51) Int. Cl.
*A24F 40/30* (2020.01)
*A24F 40/10* (2020.01)

(52) U.S. Cl.
CPC ..... *A24F 40/30* (2020.01); *A24F 40/10* (2020.01)

(58) Field of Classification Search
None
See application file for complete search history.

(56) References Cited

U.S. PATENT DOCUMENTS

| | | | | |
|---|---|---|---|---|
| 4,771,796 | A | 9/1988 | Myer | |
| 5,159,942 | A | 11/1992 | Brinkley et al. | |
| 5,261,424 | A | 11/1993 | Sprinkel, Jr. | |
| 5,708,258 | A | 1/1998 | Counts et al. | |
| 9,301,547 | B2 | 4/2016 | Liu | |
| 10,653,180 | B2 * | 5/2020 | Monsees | A24F 40/30 |
| 2002/0146242 | A1 | 10/2002 | Vieira | |
| 2007/0006889 | A1 | 1/2007 | Kobal et al. | |

(Continued)

FOREIGN PATENT DOCUMENTS

| | | | |
|---|---|---|---|
| CA | 2940842 | A1 | 9/2015 |
| CN | 102612361 | A | 7/2012 |

(Continued)

OTHER PUBLICATIONS

U.S. Appl. No. 14/304,847, filed Jun. 12, 2014, US 2014-0366898 A1.

(Continued)

*Primary Examiner* — Paul S Hyun
(74) *Attorney, Agent, or Firm* — Mintz Levin Cohn Ferris Glovsky and Popeo, P.C.

(57) ABSTRACT

A cartridge for use with a vaporization device comprising a first heating element, a first compartment for containment of a first vaporizable material, and a second compartment for containment of a second vaporizable material, wherein the device generates an aerosol for inhalation by a subject by heating the first vaporizable material or the second vaporizable material.

23 Claims, 8 Drawing Sheets

(56) References Cited

U.S. PATENT DOCUMENTS

| | | | | |
|---|---|---|---|---|
| 2008/0092912 | A1 | 4/2008 | Robinson et al. | |
| 2009/0230117 | A1 | 9/2009 | Fernando et al. | |
| 2009/0255534 | A1 | 10/2009 | Paterno | |
| 2009/0314299 | A1 | 12/2009 | Kilpatrick | |
| 2010/0313901 | A1 | 12/2010 | Fernando et al. | |
| 2012/0006343 | A1 | 1/2012 | Renaud et al. | |
| 2012/0048266 | A1 | 3/2012 | Alelov | |
| 2012/0199146 | A1 | 8/2012 | Marangos | |
| 2012/0260927 | A1 | 10/2012 | Liu | |
| 2013/0014772 | A1 | 1/2013 | Liu | |
| 2013/0220315 | A1 | 8/2013 | Conley et al. | |
| 2014/0000638 | A1 | 1/2014 | Sebastian et al. | |
| 2014/0123989 | A1 | 5/2014 | LaMothe | |
| 2014/0209105 | A1 | 7/2014 | Sears et al. | |
| 2014/0345635 | A1 | 11/2014 | Rabinowitz et al. | |
| 2014/0366898 | A1 | 12/2014 | Monsees et al. | |
| 2014/0366902 | A1 | 12/2014 | Chiolini et al. | |
| 2015/0047662 | A1 | 2/2015 | Hopps | |
| 2015/0196059 | A1 | 7/2015 | Liu | |
| 2015/0374035 | A1 | 12/2015 | Sanchez et al. | |
| 2016/0007653 | A1 | 1/2016 | Tu | |
| 2016/0044967 | A1 | 2/2016 | Bowen et al. | |
| 2019/0320718 | A1* | 10/2019 | Yilmaz | A24F 40/485 |

FOREIGN PATENT DOCUMENTS

| | | | |
|---|---|---|---|
| CN | 202738816 | U | 9/2012 |
| CN | 202873796 | U | 4/2013 |
| CN | 103156273 | A | 6/2013 |
| CN | 203748667 | U | 8/2014 |
| CN | 104544567 | A | 4/2015 |
| CN | 104684422 | A | 6/2015 |
| CN | 204409589 | U | 6/2015 |
| CN | 104770878 | A | 7/2015 |
| CN | 102762118 | B | 8/2015 |
| CN | 104968225 | A | 10/2015 |
| CN | 204837995 | U | 12/2015 |
| CN | 105473012 | B | 6/2020 |
| EP | 3085257 | A1 | 10/2016 |
| KR | 20130052119 | A | 5/2013 |
| WO | WO-2012/065310 | A1 | 5/2012 |
| WO | WO-2016062777 | A1 | 4/2016 |
| WO | WO-2016/079589 | A1 | 5/2016 |
| WO | WO-2016/135342 | A2 | 9/2016 |
| WO | WO-2016/179376 | A1 | 11/2016 |
| WO | WO-2017/207443 | A1 | 12/2017 |
| WO | WO-2018029186 | A1 | 2/2018 |

OTHER PUBLICATIONS

U.S. Appl. No. 16/095,676, filed Oct. 21, 2018, US 2019-0124982 A1.

* cited by examiner

MULTIPLE HEATING ELEMENTS WITH SEPARATE VAPORIZABLE MATERIALS IN AN ELECTRIC VAPORIZATION DEVICE

CROSS-REFERENCE TO RELATED APPLICATIONS

The present application is a continuation of U.S. patent application Ser. No. 14/304,847, filed Jun. 13, 2014, and entitled "Multiple Heating Elements with Separate Vaporizable Materials in an Electric Vaporization Device," which claims the benefit of U.S. Provisional Application No. 61/835,458, filed Jun. 14, 2013, and entitled "Multiple Heating Elements with Separate Vaporizable Materials in an Electric Vaporization Device," each of which is incorporated herein by reference in its entirety.

SUMMARY OF THE INVENTION

Devices and methods for electronic vaporization having a first heating element, a first compartment for containment of a first vaporizable material, and a second compartment for containment of a second vaporizable material wherein the device and methods generate an aerosol for inhalation by a subject by heating the first vaporizable material or the second vaporizable material.

In some aspects provided herein is a device for generating an inhalable aerosol comprising: a detachable cartridge comprising, a first compartment for containment of a first vaporizable material, a first heating element, and a second compartment for containment of a second vaporizable material, wherein the first vaporizable material in the first compartment is the same or different as the second vaporizable material in the second compartment; and a body having a battery and circuitry for controlling the device, wherein the detachable cartridge and body are coupled by a first connection mechanism and wherein the first heating element is configured to vaporize the first vaporizable material. In some embodiments the device further comprises a second heating element, wherein the second heating element is configured to vaporize the second vaporizable material. In some embodiments, the device is configured so that the first heating element is configured to vaporize the second vaporizable material. In some embodiments, the device is configured so that the first heating element comprises a resistive heater circuit or the second heating element comprises a resistive heater circuit.

In some embodiments, the device is configured so that the first heating element is configured to heat to a first target temperature, and the second heating element is configured to heat to a second target temperature. Examples of first and second target temperatures include but are not limited to from about 100° to about 300° C., from about 125° to about 255° C., from about 150° to about 230° C., from about 170° to about 210° C. In some embodiments the first target temperature is different from the second target temperature.

In some embodiments the device is be configured so that the first heating element comprises a first wire having a first end and a second end, the first wire in contact with the first wicking material, wherein the first wicking material is in fluid communication with the first vaporizable material. In some embodiments the first heating element is in the first compartment and wherein the first end and the second end of the first wire exit the first compartment and couple electrically to the body. In some embodiments of at least one aspect the second heating element comprises a second wire having a third end and a fourth end, the second wire in contact with the second wicking material, wherein the second wicking material is in fluid communication with the second vaporizable material. In some embodiments the second heating element is in the second compartment and wherein the third end and the fourth end of the second wire exit the second compartment and couple electrically to the body.

In some embodiments the device is be configured so that the first wicking material and the second wicking material have the same material properties or different material properties, same or different wicking properties, have the same wicking rate or different wicking rate due to the wicking properties of the first wicking material and the second wicking material, and the same wicking rate or different wicking rate due to configurations of the circuitry.

In some embodiments the device is be configured so that the first compartment and the second compartment are in series within the detachable cartridge relative to an airflow path, the first compartment and the second compartment are in parallel within the detachable cartridge relative to an airflow path, and the first compartment and the second compartment share a common axis within the detachable cartridge. In some embodiments the common axis is aligned with a central axis of an airflow path. In some embodiments the second compartment are stacked, concentric, aligned around a central axis, or in a parallel alignment within the detachable cartridge.

In some embodiments the first compartment and the second compartment are removable from the cartridge. In some embodiments the first compartment and the second compartment are replaceable with a third compartment or a fourth compartment in the cartridge.

In some embodiments the device is configured so that the connection mechanism comprises: a threaded connection; a tapered connection; a magnetic connection; a spring-loaded connection; a spring detent connection; a snap-fit connection; a compression connection; or any combination thereof.

In some embodiments the device is configured so that the body further comprises at least one push button for operator control of the circuitry.

In some embodiments the device is configured so that the first compartment comprises a first airflow path, and the second compartment has a second airflow path that is in communication with the first airflow path. In some embodiments the first compartment comprises a first airflow path, and the second compartment has a second airflow path, wherein first vapor from the first airflow path is introduced to second vapor from the second airflow path prior to exiting the cartridge. In some embodiments the first compartment comprises a first chamber comprising the first airflow path, and the second compartment comprises a second chamber comprising the second airflow path, wherein introduction of the first vapor to the second vapor occurs in the second chamber. In some embodiments the cartridge comprises a third chamber and introduction of the first vapor to the second vapor occurs in the chamber. In some embodiments the cartridge further comprises a mouthpiece.

In some embodiments the device is configured so that the vaporizable material comprises a liquid, a gel, a viscous material, a temperature sensitive mesophase material, or a combination thereof. In some embodiments the first vaporizable material or the second vaporizable material comprise: nicotine; flavorants; humectants; water; or a combination thereof.

In some embodiments the device is configured so that the circuitry includes an accelerometer. In some embodiments the accelerometer functions comprise: determining if a user is actively using the device; providing a battery power level feedback of the device to the user; providing the user with a mechanism to change a mode of the device; providing an automatic activation mode when the device is picked up by the user; providing a selective pre-heat mode for the resistive heating elements; and providing an automatic sleep mode when the device is inactive for a period of time.

In some embodiments the device is configured so that the cartridge is available in 2-compartment modules, 3-compartment modules, or multi-compartment modules.

In some embodiments the device is configured so that the device comprises a first capacitive sensing zone and a second capacitive sensing zone, wherein the first zone is electrically isolated from the second zone, and wherein the first zone comprises a first capacitive sensor and the second zone comprises a second capacitive sensor. In some embodiments the first zone and second zone are configured so that when the first zone and second zone are contacted by a user, the device communicates information to the user, the information comprising, a battery charge level, a vaporizable material level, a pre-heat state, or a combination thereof. In some embodiments the first zone and second zone are configured so that when a user swipes a finger from the first zone to the second zone or from the second zone to the first zone, the device communicates information to the user, the information comprising, a battery charge level, a vaporizable material level, a pre-heat state, or a combination thereof. In some embodiments the first zone and second zone are configured so that when a user swipes a finger from the first zone to the second zone or from the second zone to the first zone, the device is activated.

In some aspects provided herein is a cartridge for use with a vaporization device comprising: a first vaporizable material, a first compartment that contains the first vaporizable material, a first heating element, a second vaporizable material, and a second compartment that contains the second vaporizable material, wherein the first vaporizable material in the first compartment is the same as or different from the second vaporizable material in the second compartment, wherein the cartridge comprises a first portion of a first connection mechanism for detachable connection to a body of the vaporization device, and wherein the first heating element is configured to vaporize the first vaporizable material. In some embodiments the cartridge is configured so that the second heating element is configured to vaporize the second vaporizable material. In some embodiments the cartridge is configured so that the first heating element is configured to vaporize the second vaporizable material. In some embodiments the cartridge is configured so that the first heating element comprises a resistive heater circuit. In some embodiments the cartridge is configured so that the second heating element comprises a resistive heater circuit. In some embodiments the cartridge is configured so that the first heating element is configured to heat to a first target temperature, and the second heating element is configured to heated to a second target temperature that is different from the first target temperature, wherein the first heating element material properties are different than the second heating element material properties.

In some embodiments the cartridge is configured so that the first target temperature is from about 100° to about 300° C., from about 125° to about 255° C., from about 150° to about 230° C., from about 170° to about 210° C. In some embodiments the cartridge is configured so that the second target temperature is from about 100° to about 300° C., from about 125° to about 255° C., from about 150° to about 230° C., from about 170° to about 210° C.

In some embodiments the cartridge is configured so that a first wicking material, wherein the first heating element comprises a first wire having a first end and a second end in contact with the first wicking material, wherein the first wicking material is in fluid communication with the first vaporizable material. In some embodiments the cartridge is configured so that the first heating element is in the first compartment and wherein the first end and the second end of the first wire exits the first compartment and couple electrically to the body.

In some embodiments the cartridge is configured so that the second heating element comprises a second wire having a third end and a fourth end in contact with the second wicking material, wherein the second wicking material is in fluid communication with the second vaporizable material. In some embodiments the cartridge is configured so that the second heating element is in the second compartment and wherein the third end and the fourth end of the second wire exits the second compartment and couple electrically to a battery of the device.

In some embodiments the cartridge is configured so that the first wicking material and the second wicking material have the same material properties or different material properties. In some embodiments the cartridge is configured so that the first wicking material and the second wicking material have the same wicking properties or different wicking properties. In some embodiments the first wicking material and the second wicking material have the same wicking rate or different wicking rate due to the wicking properties of the first wicking material and the second wicking material. In some embodiments the cartridge is configured so that the first wicking material and the second wicking material have the same wicking rate or different wicking rate due to differences between the first vaporizable material and the second vaporizable material.

In some embodiments the cartridge is configured so that the first compartment and the second compartment are in series within the cartridge relative to an airflow path. In some embodiments the cartridge is configured so that the first compartment and the second compartment are in parallel within the cartridge relative to an airflow path. In some embodiments the cartridge is configured so that the first compartment and the second compartment share a common axis within the detachable cartridge. In some embodiments the cartridge is configured so that the common axis is aligned with a central axis of an airflow path. In some embodiments the cartridge is configured so that the first compartment and the second compartment are stacked, concentric, aligned around a central axis, or in a parallel alignment within the detachable cartridge.

In some embodiments, the first compartment and the second compartment are removable from the cartridge. In some embodiments the first compartment and the second compartment are replaceable with a third compartment or a fourth compartment in the cartridge.

In some embodiments the cartridge is configured so that the first connection mechanism comprises: a threaded connection; a tapered connection; a magnetic connection; a spring-loaded connection; a spring detent connection; a snap-fit connection; a compression connection; or any combination thereof.

In some embodiments the cartridge is configured so that the cartridge further comprises a mouthpiece.

In some embodiments the cartridge is configured so that the first compartment comprises a first airflow path, and the second compartment has a second airflow path that is in communication with the first airflow path. In some embodiments the first compartment comprises a first airflow path, and the second compartment has a second airflow path, wherein first vapor from the first airflow path is introduced to second vapor from the second airflow path prior to exiting the cartridge. In some embodiments the first compartment comprises a first chamber comprising the first airflow path, and the second compartment comprises a second chamber comprising the second airflow path, wherein introduction of the first vapor to the second vapor occurs in the second chamber. In some embodiments the cartridge comprises a third chamber and introduction of the first vapor to the second vapor occurs in the chamber.

In some embodiments of any aspect the device, cartridge or method comprises a pre-heat temperature for the first heating element or the second hearing element is from about 100° C. to about 130° C.

In some embodiments the cartridge is configured so that the vaporizable material comprises a liquid, a gel, a viscous material, a temperature sensitive mesophase material, or a combination thereof. In some embodiments the first vaporizable material or the second vaporizable material comprise: nicotine; flavorants; humectants; water; or a combination thereof. In some embodiments the cartridge is available in 2-compartment modules, 3-compartment modules, or multi-compartment modules.

In some aspects provided herein is a method of generating an aerosol comprising: providing an aerosol generating device comprising: a cartridge comprising, a first vaporizable material, a first compartment that contains the first vaporizable material, a first heating element, a second vaporizable material, and a second compartment that contains the second vaporizable material, wherein the first vaporizable material in the first compartment is the same or different as the second vaporizable material in the second compartment; and a body having a battery and circuitry for controlling the device, wherein the detachable cartridge and body are coupled by a first connection mechanism and wherein the first heating element is configured to vaporize the first vaporizable material, wherein the device is configured to generate a first aerosol in a first airflow path from the first vaporizable material, generate a second aerosol from the second vaporizable material in the first airflow path or a second airflow path, and deliver the first aerosol and the second aerosol to a user, or generate a first vapor in a first airflow path from the first vaporizable material, generate a second vapor from the second vaporizable material in the first airflow path or a second airflow path, and deliver to a user a third aerosol comprising condensate of the first vapor and the second vapor or a fourth aerosol generated from a third vapor, the third vapor formed when the first vapor is introduced to the second vapor or condensate thereof, or a fifth aerosol generated when the first aerosol is introduced to the second vapor or condensate thereof.

In some embodiments the first heating element is configured to heat to a first target temperature, and the second heating element is configured to heat to a second target temperature. Examples of first and second target temperatures include but are not limited to from about 100° to about 300° C., from about 125° to about 255° C., from about 150° to about 230° C., from about 170° to about 210° C. In some embodiments the first target temperature is different from the second target temperature.

In some embodiments the device is be configured so that the first heating element comprises a first wire having a first end and a second end, the first wire in contact with the first wicking material, wherein the first wicking material is in fluid communication with the first vaporizable material. In some embodiments the first heating element is in the first compartment and wherein the first end and the second end of the first wire exit the first compartment and couple electrically to the body. In some embodiments of at least one aspect the second heating element comprises a second wire having a third end and a fourth end, the second wire in contact with the second wicking material, wherein the second wicking material is in fluid communication with the second vaporizable material. In some embodiments the second heating element is in the second compartment and wherein the third end and the fourth end of the second wire exit the second compartment and couple electrically to the body.

In some embodiments the device is be configured so that the first wicking material and the second wicking material have the same material properties or different material properties, same or different wicking properties, have the same wicking rate or different wicking rate due to the wicking properties of the first wicking material and the second wicking material, and the same wicking rate or different wicking rate due to configurations of the circuitry.

In some embodiments the device is be configured so that the first compartment and the second compartment are in series within the detachable cartridge relative to an airflow path, the first compartment and the second compartment are in parallel within the detachable cartridge relative to an airflow path, and the first compartment and the second compartment share a common axis within the detachable cartridge. In some embodiments the common axis is aligned with a central axis of an airflow path. In some embodiments the second compartment are stacked, concentric, aligned around a central axis, or in a parallel alignment within the detachable cartridge.

In some embodiments the first compartment and the second compartment are removable from the cartridge. In some embodiments the first compartment and the second compartment are replaceable with a third compartment or a fourth compartment in the cartridge.

In some embodiments the connection mechanism comprises: a threaded connection; a tapered connection; a magnetic connection; a spring-loaded connection; a spring detent connection; a snap-fit connection; a compression connection; or any combination thereof.

In some embodiments the body further comprises at least one push button for operator control of the circuitry.

In some embodiments the first compartment comprises a first airflow path, and the second compartment has a second airflow path that is in communication with the first airflow path. In some embodiments the first compartment comprises a first airflow path, and the second compartment has a second airflow path, wherein first vapor from the first airflow path is introduced to second vapor from the second airflow path prior to exiting the cartridge. In some embodiments the first compartment comprises a first chamber comprising the first airflow path, and the second compartment comprises a second chamber comprising the second airflow path, wherein introduction of the first vapor to the second vapor occurs in the second chamber. In some embodiments the cartridge comprises a third chamber and introduction of the first vapor to the second vapor occurs in the chamber. In some embodiments the cartridge further comprises a mouthpiece.

In some embodiments the vaporizable material comprises a liquid, a gel, a viscous material, a temperature sensitive mesophase material, or a combination thereof. In some embodiments the first vaporizable material or the second vaporizable material comprise: nicotine; flavorants; humectants; water; or a combination thereof.

In some embodiments the first compartment comprises the first airflow path, and the second compartment comprises the second airflow path that is in communication with the first airflow path.

In some embodiments the first compartment comprises the first airflow path, and the second compartment comprises the second airflow path, wherein the device is configured to introduce the first vapor or condensate thereof from the first airflow path to second vapor or condensate thereof from the second airflow path prior to exiting the cartridge.

In some embodiments the first compartment comprises a first chamber comprising the first airflow path, and the second compartment comprises a second chamber comprising the second airflow path, wherein introduction of the first vapor of condensate thereof to the second vapor or condensate thereof occurs in the second chamber.

In some embodiments the cartridge comprises a third chamber and introduction of the first vapor or condensate thereof to the second vapor or condensate thereof occurs in the third chamber.

In some embodiments the cartridge further comprises a mouthpiece.

In some embodiments the first vaporizable material comprises water.

In some embodiments the second vaporizable material comprises water.

In some embodiments the device is configured to heat the first vaporizable material to a lower temperature than a second temperature to which the second vaporizable material is heated.

In some embodiments the device is configured to heat the second vaporizable material to a lower temperature than a second temperature to which the first vaporizable material is heated.

In some embodiments of at least one aspect described above the device is configured so the device functions as a water-cooled smoking apparatus.

INCORPORATION BY REFERENCE

All publications, patents, and patent applications mentioned in this specification are herein incorporated by reference to the same extent as if each individual publication, patent, or patent application was specifically and individually indicated to be incorporated by reference in its entirety.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

Figure 1:
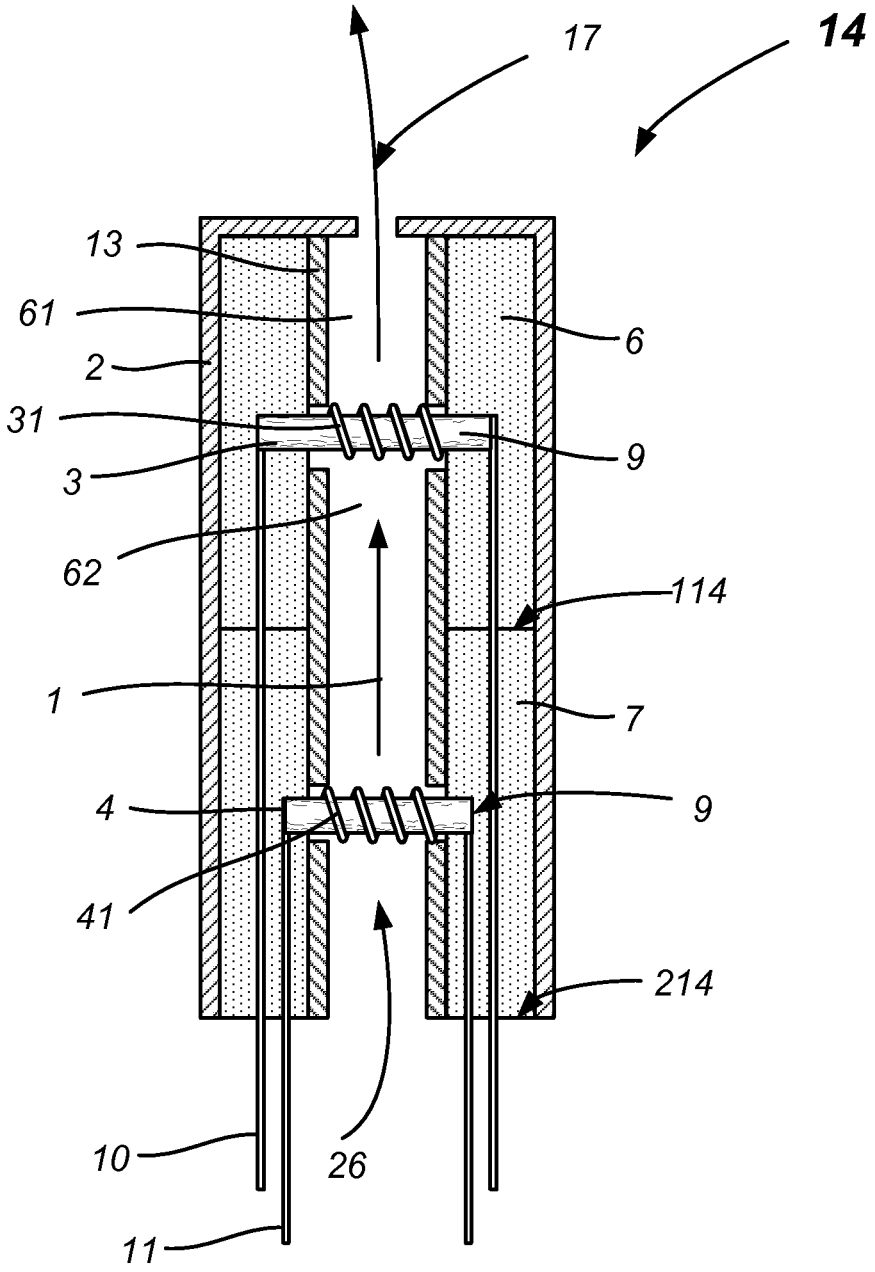
FIG. 1 illustrates a sectional view of a detachable cartridge having a first heating element, a second heating element, a first compartment for containment of vaporizable material, and a second compartment for containment of vaporizable material.

The invention described herein has a wide range of applications for inhalation of an active substance as will be appreciated by persons of skill in the art upon reviewing the disclosure. For example, the devices, and cartridges (i.e. pods), such as those disclosed in U.S. application Ser. No. 11/485,168, systems, kits and methods could be used, for example, to inhale a tobacco product through the mouth or nose. The devices, systems, kits and methods could be used, for example, to inhale any substance, such as a botanical, pharmaceutical, nutraceutical, or any other substance providing a benefit or sensation to an end user.

Further, active substances such as those disclosed in U.S. application Ser. No. 14/271,071, similar formulations and methods could be used, for example, providing a benefit or sensation to an end user.

Provided herein is a device for generating an inhalable aerosol comprising; a detachable cartridge having a first heating element, a second heating element, a first compartment for containment of vaporizable material, and a second compartment for containment of vaporizable material, wherein the vaporizable material in the first compartment is the same or different as the vaporizable material in the second compartment, and a body having a battery and circuitry for controlling the device wherein the cartridge and body are coupled by a first connection mechanism.

The detachable cartridge comprises multiple compartments with at least one compartment having at least one heating element and at least one vaporizable material. The device is configured such that each compartment containing at least one resistive heating element also comprises a wicking material that is in direct contact with the vaporizable material in the compartment. At least one heating element in at least one compartment is exposed to an air passage in the cartridge.

At least one resistive heater in the cartridge is designed to reach a closely controlled target temperature, below the pyrolytic temperature of tobacco, and more specifically, a target "vapor temperature", greater than about 100° C., but less than about 300° C., intended to convert the vaporizable material of at least one compartment to a visible vapor, such as about 170° C. for flavorants, about 190° C. for nicotine, and about 210° C. for humectants.

In some embodiments, at least one resistive heater comprises wire coil wrapped around a wicking material (e.g. silica) that penetrates a moisture resistant liquid barrier of at least one compartment holding the vaporizable material and allows the vaporizable material to "wick" around the wire and be heated to a controlled temperature when activated. This occurs when the ends of wires traversing the length of the cartridge, exiting the compartment distally and connecting to the body, are activated by a mechanism, optionally a button mechanism, and circuitry connected to the battery in the body. Additionally, different wicking rates of the vaporizable material in the compartment is obtained using different wick materials and/or different arrangements of the heating element and the wick (e.g. heating element wrapped around the wick, heating element passing through the wick). Wicking materials at least comprise silica, cotton, stainless steel mesh, and Ekowool. Wicking properties, which effect wicking rates, include wicking material density, composition, dimension, shape, size, length, width, among others. One of ordinary skill in the art would recognize the relationship between wicking material properties and arrangements of the heating element and the wick and the effects on wicking rates.

In some embodiments wicking material of the first heating element is the same or different than the wicking material of the second heating element. Heating element material properties include heating element material composition, density, dimension, shape, size, length, width, among others. In some embodiments, the wicking material of the first heating element is the same as the wicking material of the second heating element and the wicking rate of the vaporizable material in the first compartment to at least one heating element is the same or different as the wicking rate of the vaporizable material in the second compartment to at least one heating element. In some embodiments, the wicking material of the first heating element is different than the wicking material of the second heating element, and the wicking rate of the vaporizable material in the first compartment to at least one heating element is the same or different as the wicking rate of the vaporizable material in the second compartment to at least one heating element.

In some embodiments the vaporizable material in the first compartment is the same as the vaporizable material in the second compartment, and the target temperature for the first heating element is the same or different as the target temperature for the second heating element. In some embodiments, the vaporizable material in the first compartment is different than the vaporizable material in the second compartment, and the target temperature for the first heating element is the same or different as the target temperature for the second heating element. Target temperatures at least comprise temperatures below the pyrolytic temperature of tobacco, greater than about 100° C. but less than about 300° C., about 170° C. for flavorants, about 190° C. for nicotine, about 210° C. for humectants, about 100° C., about 120° C., about 140° C., about 160° C., about 180° C., about 200° C., about 220° C., about 240° C., about 260° C., about 280° C., and about 300° C.

In some embodiments, the vaporizable material in the first compartment is the same as the vaporizable material in the second compartment, and the temperature range for the first heating element is the same or different than the temperature range for the second heating element. In some embodiments, the vaporizable material in the first compartment is different than the vaporizable material in the second compartment, and the temperature range for the first heating element is the same or different than the temperature range for the second heating element. Temperatures ranges at least comprise temperatures below the pyrolytic temperature of tobacco, greater than about 100° C. but less than about 300° C., about 170° C. for flavorants, about 190° C. for nicotine, about 210° C. for humectants, about 125° to about 255° C., about 150° to about 230° C., about 170° to about 210° C.

In some embodiments, the vaporizable material in the first compartment is the same as the vaporizable material in the second compartment, and the heating parameters for the first heating element is the same or different than the heating parameters for the second heating element. In some embodiments the vaporizable material in the first compartment is different than the vaporizable material in the second compartment, and the heating parameters for the first heating element is the same or different than the heating parameters for the second heating element. Heating parameters at least comprise target temperature, temperature range, heating duration, heating frequency, and heating control. One of ordinary skill in the art would recognize heating parameters that effect function of the aerosol generating devices described herein.

In some embodiments, the resistive heater elements within at least one compartment for containment of vaporizable material are "breath-activated" when the user puffs on the device. This activation mode is accomplished by vacuum activated contact switches and or solid state pressure sensors and circuitry connected to the battery in the attachable body.

In still other embodiments, at least one resistive heater element within at least one compartment for containment of vaporizable material is selectively activated when the user picks up the device. This activation mode is accomplished by a button mechanism, an accelerometer, and/or solid state sensors and circuitry connected to the battery in the attachable body. The selective activation cycle has several modes including but not limited to a "preheat" setting for the resistive heaters that brings the temperature of at least one resistive heater up to a "pre-vaporization" temperature (e.g.: 100°-130° C.); a sleep mode where the device deactivates and shuts down after a short period of time; or an "off" mode when no use or movement is detected for a longer period of time, or the user manual changes the mode and/or deactivates the device with the button.

In some embodiments, at least one resistive heater wire is inserted through or surrounded by wicking material in direct contact with one of the compartments containing vaporizable material. The ends of wires traverse the length and exit the compartment distally where they attach to a first connection mechanism in the distal end of the cartridge that matches a second connection mechanism on the body.

In some embodiments, the detachable cartridge is a single-unit construction wherein the entire cartridge with all of its components, are replaced en masse.

In some embodiments, the detachable cartridge is a modular construction wherein the first and/or second compartments containing vaporizable material and a heater, or combinations of multiple compartments, each containing vaporizable material and a heater, are removable. In some embodiments, the individual compartments and heaters are arranged in a stacked-series configuration, a parallel configuration, a concentric configuration, or any combination of series-stacked, parallel or concentric configuration within the detachable cartridge.

In some embodiments, the individual compartments containing the vaporizable materials and heaters within the cartridge are removable and replaceable. In still other embodiments the individual compartments containing the vaporizable materials and heaters within the cartridge are interchangeable with replacement components. In some embodiments, the individual compartments containing the vaporizable materials and heaters within the cartridge are recyclable and reusable and is refilled by the user.

In some embodiments, the device comprises different connection mechanisms between the detachable cartridge and the body. In some embodiments, the connection mechanisms comprise; a threaded connection, a tapered connection, a magnetic connection, a spring-loaded connection, a spring detent connection, a snap-fit connection, a compression connection, or any combination thereof.

In some embodiments, the body also comprises at least one push button for operator control of the circuitry. In some embodiments, the body also comprises at least one LED indicator to apprise the user of a functional operation of the device.

In some embodiments the battery is not rechargeable. In some embodiments the battery is rechargeable. In some embodiments the battery is a lithium-based rechargeable battery. In some embodiments the attachable body comprises a mechanism for recharging the battery.

In some embodiments the device is configured to further comprise a detachable mouthpiece, wherein the mouthpiece is the detachable cartridge. In some embodiments the mouthpiece has at least one air passage therethrough and at least one heating element is exposed to the air passage. In some embodiments the detachable mouthpiece cartridge is a single-unit, non-modular construction. In some embodiments the compartments for containment of vaporizable material are aligned in series within the detachable mouthpiece cartridge, are aligned in parallel within the detachable mouthpiece cartridge, are aligned concentrically within the detachable mouthpiece cartridge, and/or are aligned in any combination of series stacking, concentric, and parallel alignment within the detachable mouthpiece cartridge.

Figure 4:
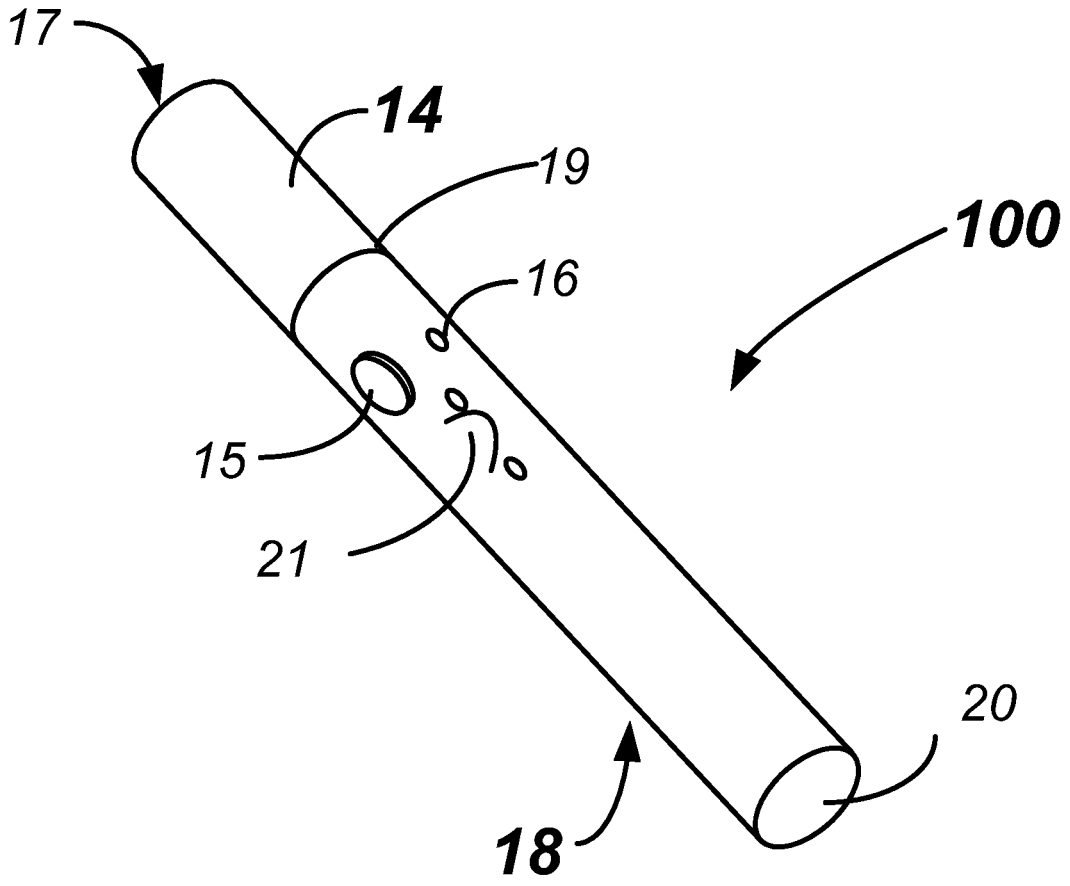
FIG. 4 illustrates an isometric representation of the invention with dimensions and aspect ratio similar to a conventional cigarette.

Provided herein is a device for generating an inhalable aerosol comprising; a detachable cartridge having a first heating element, a second heating element, a first compartment for containment of vaporizable material, and a second compartment for containment of vaporizable material, wherein the vaporizable material in the first compartment is the same or different as the vaporizable material in the second compartment; and an attachable body having a battery and circuitry for controlling the device wherein the detachable cartridge and body are coupled by a first connection mechanism. An exemplary device 100 is illustrated in FIG. 4 comprising a detachable cartridge 14, having an air outlet 17, internal compartments for containment of vaporizable material (not shown), heating elements (not shown), at least one air inlet (not shown), and a first connection mechanism 19. Also included is a body 18 comprising an activation button 15, an air inlet 16, a second connection mechanism 19, an optional glow indicator LED 20, a mode indicator LED 21, an internal battery (not shown), an optional accelerometer (not shown), and internal circuit board and circuitry (not shown). In some embodiments a detachable mouthpiece comprises the cartridge 14. In some embodiments a detachable mouthpiece is the cartridge 14.

Figure 6:
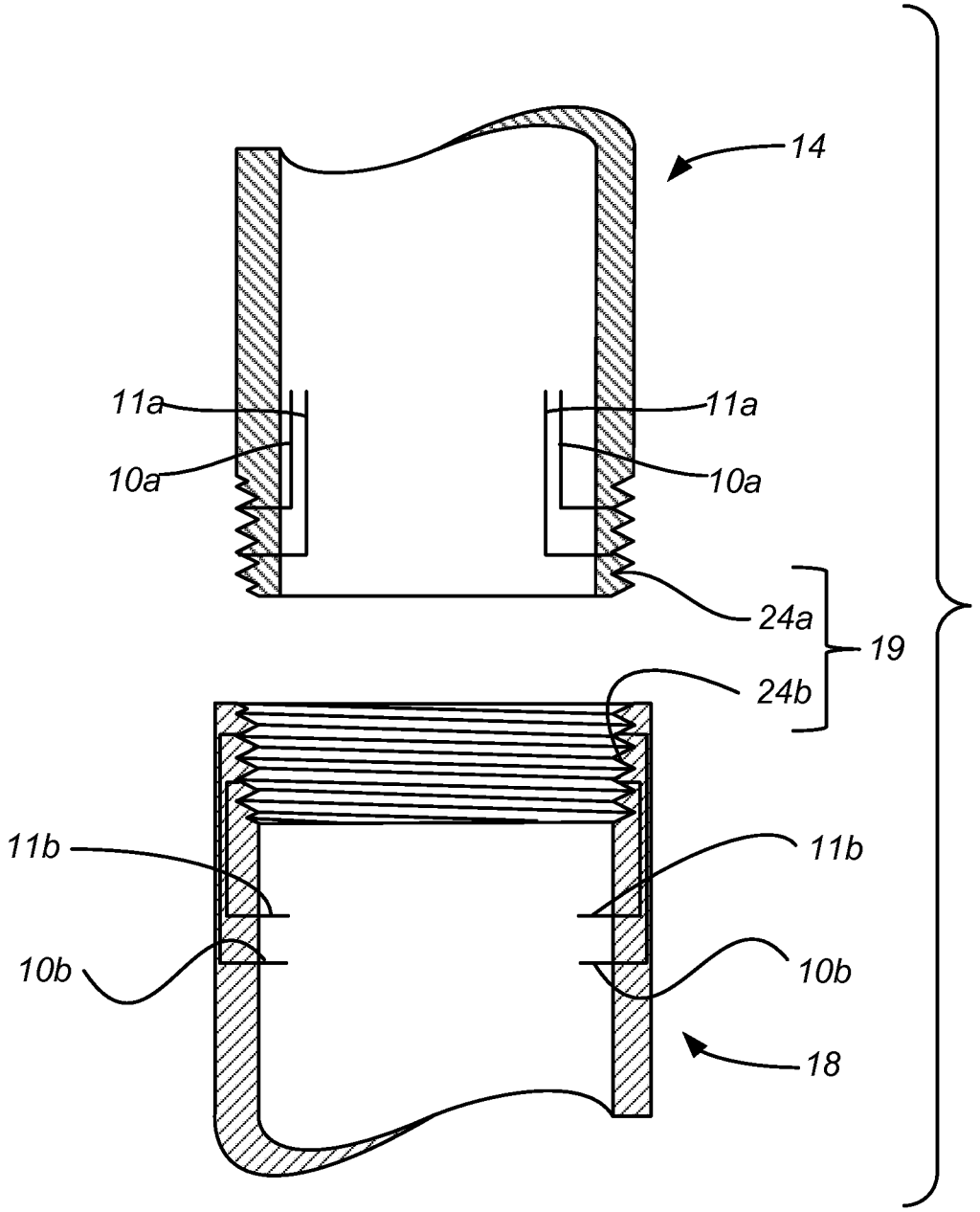
FIGS. 6, 7 & 8 illustrate representative examples of possible connection mechanisms for the inventive device.
Figure 7:
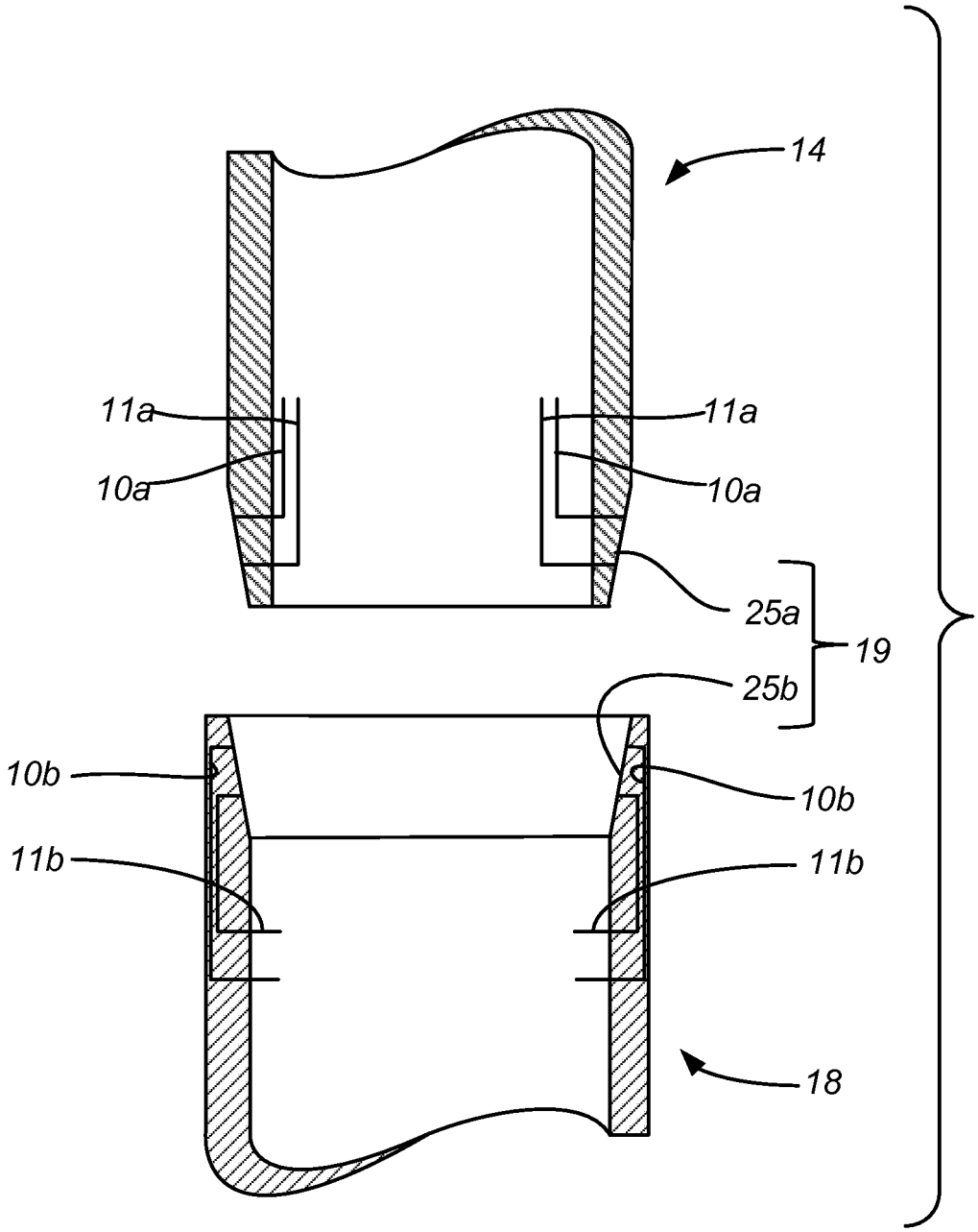
Figure 8:
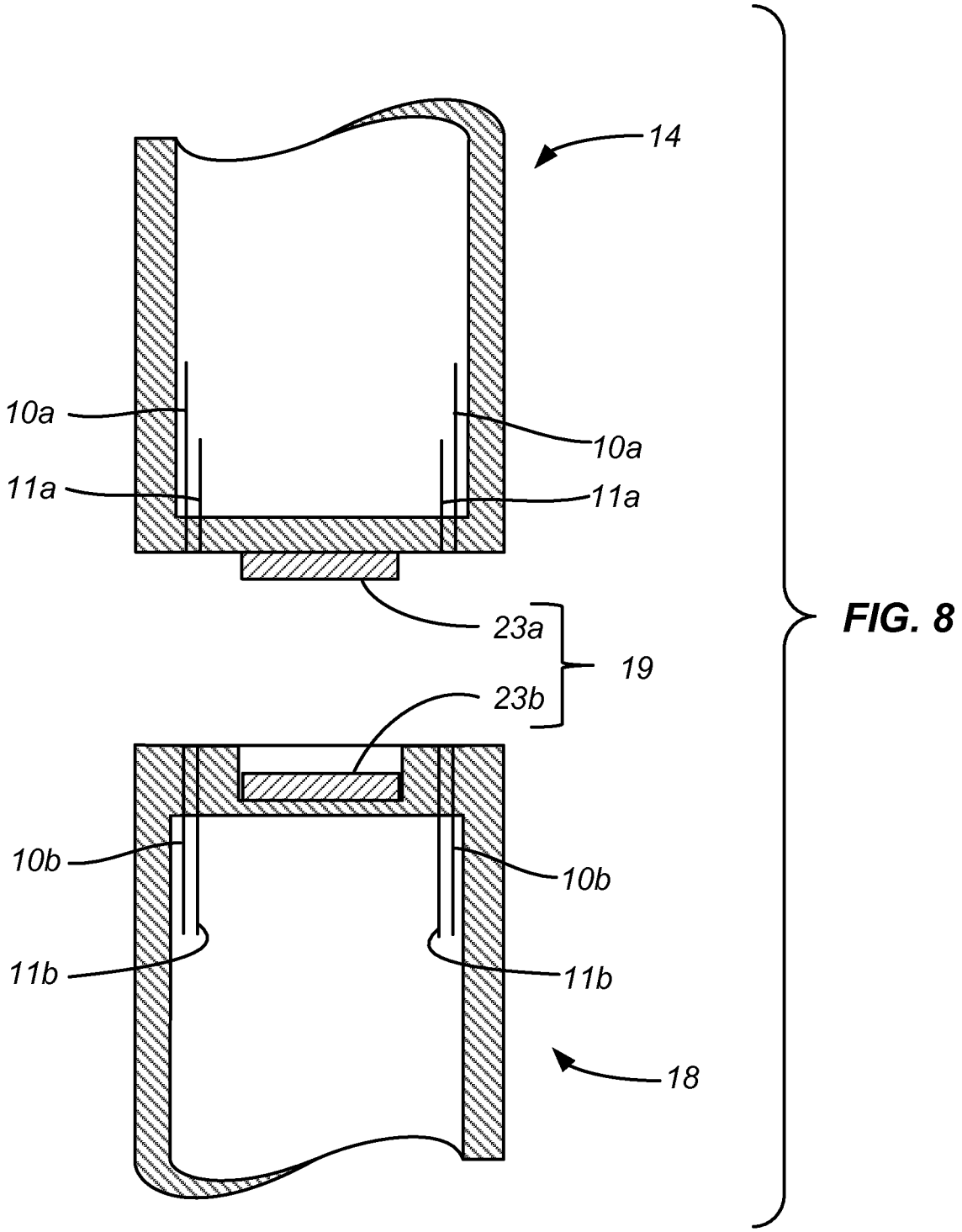

As shown in FIG. 4, the halves of the exemplary device form a separable, but firm connection 19 and resemble a typical cigarette in appearance. The connection mechanism 19, also interchangeably referred to as an attachment mechanism, is achieved in numerous ways. As shown in FIGS. 6, 7, 8, an attachment mechanism 19 may include and be herein represented by, but are not limited to, a threaded connection 24*a*, 24*b*, a tapered connection 25*a*, 25*b*, a magnetic connection 23*a*, 23*b*, as illustrative examples, or, a spring-loaded connection (not shown), a spring detent connection (not shown), a snap-fit connection (not shown), a compression connection (not shown), or any combination thereof. In some instances, the device 100 is manufactured as a single-use inseparable outer body. In some embodiments, the single button interface 15 provides the mechanism for on, off and wake from sleep. Alternatively, an accelerometer (not shown), provides the mechanism for on, off and wake from sleep. In some embodiments, the single button interface also provides the mechanism for selection of specific heater activation within the cartridge. In some embodiments, (not shown) additional buttons are included for any of these functions. For example, pressing the single button for 1 second turns the device on. Continuing to hold the button for 5 seconds disables the motion-based low power standby and automatic shut-down. Alternatively, a second button is used to disable the motion-based low power standby and and/or shut-down. In some embodiments, upon power-up, if the single button is depressed for a very long period (>10 seconds), the device turns off again. This is to prevent inadvertent activation while in a purse, etc. While on, pressing the button momentarily turns it off. In some embodiments, a single or more than one button could report battery level (via LED blinks, for instance), change operating temperature of the device, or change the nominal intensity of the LED(s)—if the user is in a dark environment and does not want the light to be distracting. These various features could be triggered with one or more buttons or with the same button by pressing it for a prescribed duration or number of presses.

Provided herein is a device for generating an inhalable aerosol, comprising; a detachable cartridge having a first heating element, a second heating element, a first compartment for containment of vaporizable material, and a second compartment for containment of vaporizable material, wherein the vaporizable material in the first compartment is the same or different as the vaporizable material in the second compartment; and a body having a battery, at least one activation button, and circuitry for controlling the device, wherein the device comprises a first capacitive sensor coupled to the circuitry. In some embodiments, a surface or shell of the device triggers the first capacitive sensor upon a user input to the surface or shell of the device. In some embodiments, a capacitive sensing surface of the first capacitive sensor detects when a user is holding the device, causing the device to indicate that the device is in use or a ready state. In some embodiments, the circuitry causes the heating elements to enter a pre-heat state upon activation or triggering of the first capacitive sensor. In some embodiments, the device exits the pre-heat state or turns off when the first capacitive sensor no longer detects movement of the device. In some embodiments, a surface of the device comprises two electrically isolated capacitive sensing zones wherein the first zone comprises s first capacitive sensor, and the second zone comprises a second capacitive sensor. In some embodiments, when a user contacts a first zone, the device indicates to the user that the device is in use or in a ready state. In some embodiments, the device indicates use or ready state by displaying a pattern of one or more LED(s), displaying a predetermined color of one or more LED(s), or provides an audio signal. In some embodiments, the zones are configured such that when a user touches one of the zones in a predetermined pattern of one or more touches, the device displays a charge level of the battery with a pattern of one or more LED(s) or with a color of one or more LED(s), or with an audio signal. In some embodiments, the zones are configured such that when a user swipes a finger from the first zone to the second zone, or from the second zone to the first zone, the device displays a charge level of the battery with a pattern of one or more LED(s) or with a color of one or more LED(s), or with an audio signal. In some embodiments the device is configured to further comprise a detachable mouthpiece, wherein the mouthpiece is the detachable cartridge. In some embodiments the mouthpiece has at least one air passage there through and at least one heating element is exposed to the air passage. In some embodiments the detachable mouthpiece cartridge is a single-unit, non-modular construction. In some embodiments the compartments for containment of vaporizable material are aligned in series within the detachable mouthpiece cartridge, are aligned in parallel within the detachable mouthpiece cartridge, are aligned concentrically within the detachable mouthpiece cartridge, and/or are aligned in any combination of series stacking, concentric, and parallel alignment within the detachable mouthpiece cartridge. In some embodiments, touching the device to lips of a user activates a second capacitive sensor coupled to the circuitry whereby the device heating elements enter a pre-heat state. In some embodiments, when the user inhales the heating elements get fully activated and generate aerosol that is deliverable to the user by such inhalation or by additional inhalation. In some embodiments, inhalation activates a pressure switch to fully activate the heater elements. In some embodiments, the device comprises a button or touch sensor that when pushed or touched fully activates the heater elements and generates aerosol that is deliverable to a user by inhalation thereby.

As described herein and further shown in FIG. 1, one exemplary illustration of the detachable cartridge 14 comprises a shell or outer housing 2, having a single central airpath 1 there through with an air inlet 26 and air outlet, 17, and a first and second stacked compartments 114, 214, respectively, each surrounded by a liquid barrier 13, and filled with an absorbent batting material 6, 7 that will absorb and hold a first and second vaporizable material. The vaporizable materials in the stacked compartments 114, 214 is the same or different. Also within each cartridge, and centered within the central airpath is a first and second resistive heater element 3, 4, respectively. One exemplary design of these resistive heater elements 3, 4 include wire coils 31, 41 wrapped around a silica wick 9. The wire coils 31, 41 are coupled to heater circuit wires 10, 11 (alternatively called heater wires herein), which deliver energy to the coils 31, 41 which results in the coils heating up and aerosolizing the liquid vaporizable material wicked by the wicking material 9 from their respective compartments 114 or 214. While the wires 10, 11 are described herein as being coupled to coils 31, 41, other designs of these heating elements are contemplated herein which would be obvious to one of ordinary skill in the art upon reading the disclosure herein. Further, other wick materials are envisioned and must be capable of withstanding the target temperatures generated by the resistive heating element, without changing the flavor of the vapor or imparting an undesirable taste to the end user. The wicking material 9, extends through the inner liquid barrier walls 13, along with the heater circuit wires 10, 11 for the resistive heater elements 3, 4. This provides a steady and even flow of liquid vaporizable material to the resistive heater elements 3, 4 until the vaporizable material within at least one compartment is exhausted. Immediately proximal to each heater element 3, 4, and in the central airpath, is an atomizing chamber 61, 62 where the vapor generated from the heating element will form and mix with inlet air and the vapors formed from any previous heating elements in the airpath 1. In addition, the heater element circuit wires 10, 11 may extend either through, or along side of, adjacent compartments 114, 214 until they reach the first connection mechanism (not shown) at the distal end of the detachable cartridge 14. The wires then couple to the circuitry of the device which controls the activation and other features of the heater elements, and thus control the timing, delivery, contents, and amount, at least, of the vapor or aerosol deliverable to the user. In some embodiments a detachable mouthpiece comprises the cartridge 14. In some embodiments a detachable mouthpiece is the cartridge 14.

Figure 2:
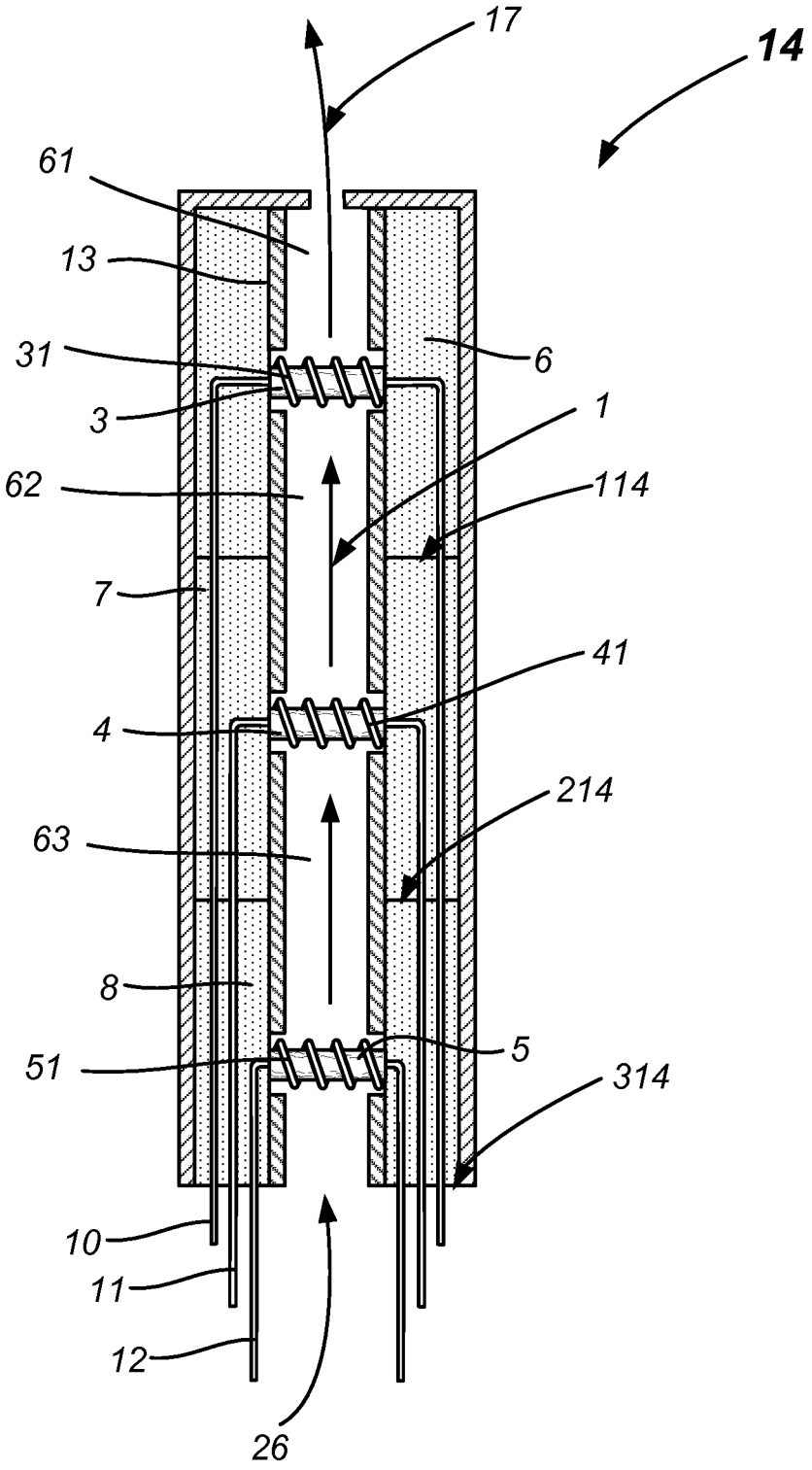
FIG. 2 illustrates a sectional view of a detachable cartridge having a second heating element, a third heating elements, a first compartment for containment of vaporizable material, a second compartment for containment of vaporizable material, and a third compartment for containment of vaporizable material.

In some embodiments of the detachable cartridge 14, as shown in FIG. 2, the cartridge 14 comprises a shell or outer housing 2, having a single central airpath 1 therethrough, a first, second and third stacked compartments 114, 214, and 314, respectively, each surrounded by a liquid barrier 13, and filled with an absorbent batting material 6, 7, and 8 that will absorb and hold a first, second and third vaporizable material. The vaporizable material in the first, second and third compartments is the same or different. Also within each cartridge, and centered within the central airpath is a first, second, and third resistive heater element 3, 4, and 5, respectively. As described previously, an exemplary design of these resistive heater elements 3, 4, and 5 include wire coils 31, 41, and 51 wrapped around a silica wick 9. The wicking material 9, extends through the inner liquid barrier walls 13, along with the circuit wires 10, 11, and 12 for the resistive heater elements 3, 4 and 5. This provides a steady and even flow of liquid vaporizable material to the resistive heater elements 3, 4 and 5 until the vaporizable material within at least one compartment 114, 214, 314 is exhausted. Immediately proximal to each heater coil 31, 41, and 51, and in the central airpath, is an atomizing chamber 61, 62 and 63 where the vapor generated from the heating element will form and mix with inlet air and the vapors formed from any previous heating elements in the airpath 1. In addition, the heater element circuit wires 10, 11, and 12 may extend either through, or along side of, adjacent compartments 114, 214, and 314 until they reach the first connection mechanism (not shown) at the distal end of the detachable cartridge 14. In some embodiments a detachable mouthpiece comprises the cartridge 14. In some embodiments a detachable mouthpiece is the cartridge 14.

Figure 3:
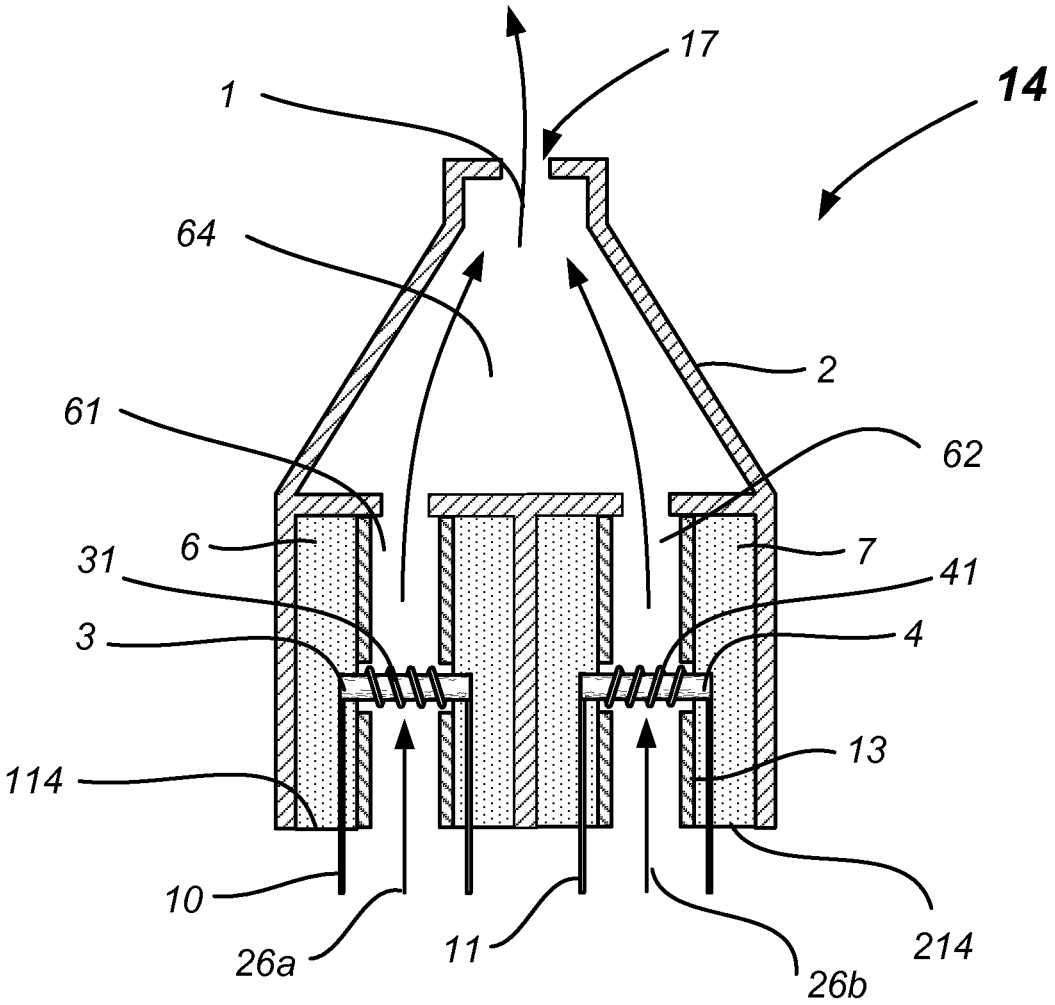
FIG. 3 illustrates a sectional view of a detachable cartridge having two heating elements and two compartments for containment of vaporizable material in a parallel or concentric configuration.

Still further, an additional exemplary illustration of the detachable cartridge 14 as shown in FIG. 3 comprises a shell or outer housing 2, having multiple air inlets 26*a*, 26*b*, etc., and compartments, ultimately culminating into a single central airpath 1 at the air outlet, 17. The illustrative embodiment comprises two parallel or circumferentially located compartments 114, 214, respectively, however, one skilled in the art will recognize that there may be multiple circumferentially-located compartments; (e.g.: 3, 4, 5, etc.). The vaporizable material in the first and second compartments is the same or different. The vaporizable material in multiple compartments is the same or different. In some embodiments a detachable mouthpiece comprises the cartridge 14. In some embodiments a detachable mouthpiece is the cartridge 14.

The illustrative embodiment in FIG. 3 comprises two parallel or circumferentially located compartments 114, 214, each surrounded by a liquid barrier 13, and filled with an absorbent batting material 6, 7 that will absorb and hold a first and second vaporizable material. Also within each cartridge, and centered within the respective airpaths 26*a*, 26*b* is a first and second resistive heater element 3, 4. As described previously, the exemplary design of these resistive heater elements 3, 4 include wire coils 31, 41 wrapped around a silica wick 9. The wicking material 9 extends through the inner liquid barrier walls 13, along with the circuit wires 10, 11 for the resistive heater elements 3, 4. This provides a steady and even flow of liquid vaporizable material to the resistive heater elements 3, 4 until the vaporizable material within at least one compartment 114, 214 is exhausted. Immediately proximal to each coil 31, 41, and in the respective airpath, is an atomizing chamber 61, 62 where the vapor generated from the heating element will form and mix with inlet air from the air inlets 26*a*, 26*b*. Ultimately, the airpaths converge into a central atomizing chamber 64 within a single airpath 1, where the vapors mix before exiting through the air outlet 17. In addition, the heater element circuit wires 10, 11 extend through or along side of adjacent compartments 114, 214 until they reach the first connection mechanism (not shown) at the distal end of the detachable cartridge 14. In some embodiments a detachable mouthpiece comprises the cartridge 14. In some embodiments a detachable mouthpiece is the cartridge 14.

As illustrated in FIGS. 6, 7, and 8 and briefly described previously, a plurality of connection mechanisms are contemplated for the device which comprise threaded connections 24*a*, 24*b*, tapered connections 25*a*, 25*b*, magnetic connections 23*a*, 23*b*, as illustrative examples, or, a spring-loaded connection (not shown), a spring detent connection (not shown), a snap-fit connection (not shown), a compression connection (not shown), or any combination thereof. The connectors shown in FIGS. 6, 7, and 8 could be part of a detachable cartridge and/or a mouthpiece comprising a detachable cartridge.

FIGS. 6 and 7 illustrate non-limiting examples for a threaded connection 24*a*, 24*b* and (Morse) taper connection 25*a*, 25*b* respectively where the heater circuit wires 10*a*, 11*a*, (and 12*a* in a 3-heater element design), could be inserted along the inner diameters to specific longitudinal locations corresponding to the mating connections 10*b*, 11*b*, (and 12*b* in a 3-heater element design), in the attachable body (electronics and battery module). Similarly, FIG. 8 illustrates a simple butted-end connection, with a pair of magnets 23*a*, 23*b*, (or a single magnet 23 and conductive counter-sunk mating endplate. The heater circuit wires 10*a*, 11*a* could be inserted at various aligned point locations on the mating end corresponding to the mating connections 10*b*, 11*b* in the attachable body (electronics and battery module).

One skilled in the art will quickly recognize that based on the description herein, any combination of cartridge and heater element circuit arrangement as described herein would be possible for alternative cartridge embodiments.

One skilled in the art will quickly recognize that based on the description herein, any combination of mouthpiece, cartridge and heater element circuit arrangement as described herein would be possible for alternative mouthpiece and/or cartridge embodiments.

Provided herein is a device 100 as shown in FIGS. 1, 2, 3 and 5 for generating an inhalable aerosol comprising; a removable cartridge 14 having a proximal end and a distal end, wherein, the removable cartridge 14 comprises; an outer shell 2, a first connection mechanism 19 at the distal end, at least one air inlet in the distal end 26, a first heating element 3 with circuitry 10, a second heating element with circuitry 11, a first compartment containment of vaporizable material 114, a second compartment containment of vaporizable material 214, wherein the vaporizable material in the first compartment 114 is the same or different as the vaporizable material in the second compartment 214, at least one airpath 1 therethrough having exposure to at least one compartment for containment of vaporizable material 114, 214 and at least one heating element 3, 4, comprising heating coils 31, 41, a liquid barrier 13 to isolate the vaporizable materials within at least one compartment and from at least one airpath, an air outlet 17 at the proximal end; and a body 18 having a proximal end and a distal end, coupleable to the cartridge with a second connection mechanism 19; wherein, the body comprises; an outer shell 2, the second connection mechanism 19 at the proximal end, an air inlet in the outer shell 16, at least one indicator light or mode indicator LED 20, 21, a battery 70, circuitry 80, 90 for controlling the device, at least one operator-controlled push-button 15 connected to the circuitry through the outer shell, and an air outlet 27 in the proximal end. In some embodiments a detachable mouthpiece comprises the cartridge 14. In some embodiments a detachable mouthpiece is the cartridge 14.

In some embodiments, the device for generating an inhalable aerosol is an electronic cigarette 100. In some embodiments, the device for generating an inhalable aerosol is an electronic cigar (not shown). In some embodiments, the device for generating an inhalable aerosol is an electronic pipe (not shown). In some embodiments, the device for generating an inhalable aerosol is an electronic water-cooled smoking apparatus (not shown).

Still further, the removable cartridge 14 comprises at least one atomizing chamber 61, 62, 63, 64 adjacent and proximal to the resistive heating elements 3, 4, 5 and heater coils 31, 41, 51. In some embodiments a detachable mouthpiece comprises the cartridge 14. In some embodiments a detachable mouthpiece is the cartridge 14.

In some embodiments, the vaporizable material is a liquid, a gel, a viscous material, a temperature sensitive mesophase material.

Figure 5:
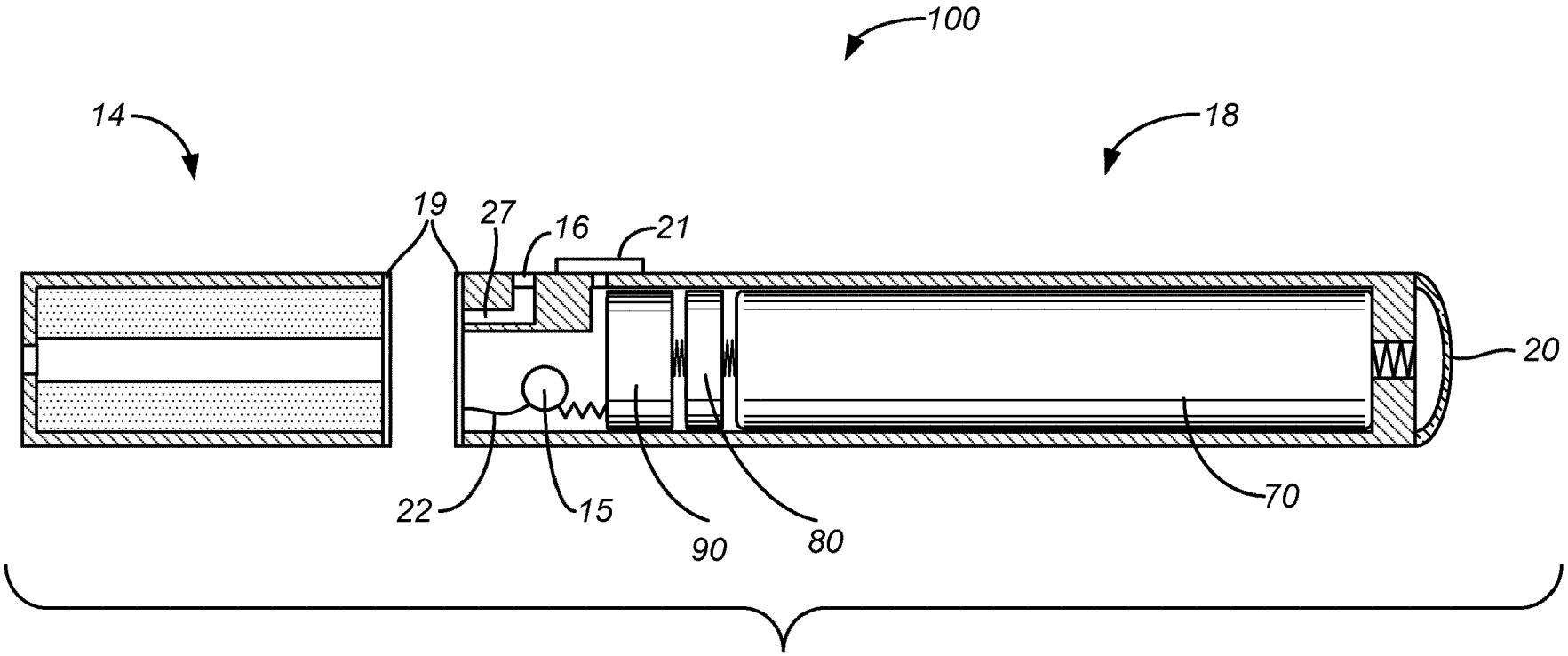
FIG. 5 illustrates a representative sectional view of the inventive device described in FIG. 4.

As shown in the representative body/electronics and battery module cross-section of FIG. 5, in some embodiments of the device, the circuitry controls the selection of the electronic heaters to be activated. This may be accomplished in a number of ways, including but not limited to push button controls 15, having power supply wires 22 for coupling to the heater wires extending to the first connection mechanism 19, pressure sensitive or solid state pressure switches (not shown), a circuit board (alternatively called circuitry or control circuitry herein) 80, or an accelerometer 90 to name a few.

In some embodiments of the device, the compartments for containment of vaporizable material contain nicotine, flavorants, humectants, or water.

In some embodiments of the device, the compartments for containment of vaporizable material 114, 214, 314 with individual resistive heating elements 3, 4, 5, respectively, are prefilled with the same or different vaporizable material. In some embodiments of the device, the compartments for containment of vaporizable material 114, 214, 314, with individual resistive heating elements 3, 4, 5, respectively, is filled by the user with the same or different vaporizable material. In some embodiments of the device, the compartments for containment of vaporizable material 114, 214, 314, with individual resistive heating elements 3, 4, 5, respectively, are recyclable and/or reusable.

In some embodiments of the device, a mouthpiece comprises the compartments for containment of vaporizable material 114, 214, 314 with individual resistive heating elements 3, 4, 5, respectively, are prefilled with the same or different vaporizable material. In some embodiments of the device, the compartments for containment of vaporizable material 114, 214, 314, with individual resistive heating elements 3, 4, 5 is filled by the user with the same or different vaporizable material. In some embodiments of the device, the compartments for containment of vaporizable material 114, 214, 314, with individual resistive heating elements 3, 4, 5, respectively, are recyclable and/or reusable.

In some embodiments of the device, the compartments for containment of vaporizable material 114, 214, 314, with individual resistive heating elements 3, 4, 5 are replaceable and the housing is reusable.

In some embodiments of the device, a mouthpiece comprises the compartments for containment of vaporizable material 114, 214, 314, with individual resistive heating elements 3, 4, 5, respectively, are replaceable and the mouthpiece is reusable.

In some embodiments of the device, the cartridge comprising the compartments for containment of vaporizable material are available in 2-element modules 114, 214; 3-element modules 114, 214, 314; or multi-element modules 114, 214, 314, . . . "x14".

In some embodiments of the device, a detachable mouthpiece comprises a cartridge comprising the compartments for containment of vaporizable material, wherein the mouthpiece is available in 2-element modules 114, 214; 3-element modules 114, 214, 314; or multi-element modules 114, 214, 314, . . . "x14". In some embodiments of the device, a detachable mouthpiece comprises a cartridge comprising the compartments for containment of vaporizable material, wherein the cartridge comprising the compartments for containment of vaporizable material are available in 2-element modules 114, 214; 3-element modules 114, 214, 314; or multi-element modules 114, 214, 314, . . . "x14"

In still other embodiments of the device the target temperatures for the heating elements 3, 4, 5 is below the combustion temperature for tobacco. In still other embodiments of the device the target temperatures for the heating elements 3, 4, 5 is below the pyrolysis temperature for tobacco. More specifically, a target "vapor temperature" is greater than about 100° C., but less than about 300° C., intended to convert the vaporizable material of at least one compartment to a visible vapor. In some embodiments of the device, the target temperature for the heating elements for nicotine is about 190° C. In some embodiments of the device, the target temperature for the heating elements for flavorants is about 170° C. In some embodiments of the device, the target temperature for the heating elements for humectants is about 210° C.

Still further, in some embodiments the circuitry includes an accelerometer 90 as previously noted and shown in FIG. 5. In some embodiments the accelerometer functions comprise; determining if a user is actively using the device, providing a pre-heat condition for the heating elements, providing a battery power level feedback of the device to the user, providing user with a mechanism to change available modes of the device, providing an automatic activation mode when the device is picked up by the user, providing an automatic sleep mode when the device is inactive for a period of time. Direct visual feedback is provided to the user through the use of at least one LED light indicator 20, or Mode indicator 21.

Provided herein is a device for generating an inhalable aerosol, comprising; a detachable cartridge comprising, a first heating element, a second heating element, a first compartment for containment of vaporizable material, and a second compartment for containment of vaporizable material, wherein the vaporizable material in the first compartment is the same or different as the vaporizable material in the second compartment; and a body having a battery, an activation button, and circuitry for controlling the device, wherein the device generates an aerosol substantially free from at least one Hoffman analyte upon heating the vaporizable material to a target temperature. In some embodiments the device is configured to further comprise a detachable mouthpiece, wherein the mouthpiece is the detachable cartridge. In some embodiments the mouthpiece has at least one air passage therethrough and at least one heating element is exposed to the air passage. In some embodiments the detachable mouthpiece cartridge is a single-unit, non-modular construction. In some embodiments the compartments for containment of vaporizable material are aligned in series within the detachable mouthpiece cartridge, are aligned in parallel within the detachable mouthpiece cartridge, are aligned concentrically within the detachable mouthpiece cartridge, and/or are aligned in any combination of series stacking, concentric, and parallel alignment within the detachable mouthpiece cartridge.

In some embodiments, the Hoffman analyte is selected from the group consisting of: ammonia, aminonaphthalenes, benzopyrene, formaldehyde, acetaldehyde, acetone, methyl ethyl ketone, butyraldehyde, hydrogen cyanide, nitrous oxides, tobacco-specific nitrosamines (TSNAs), pyridine, quinoline, hydroquinone, phenol, cresols, tar, nicotine, carbon monoxide, 1,3-butadiene, isoprene, acrylonitrile, benzene, toluene, and styrene. In some embodiments, the aerosol comprises particles less than about 2 microns in diameter. In some embodiments, the device generates an aerosol upon heating a vaporizable material to a target temperature with at least 70% less Hoffman analytes than a common tobacco cigarette. In some embodiments, the device generates an aerosol comprising particles less than about 2 microns in diameter.

Provided herein is a method of delivering an aerosol substantially free from a Hoffman analyte to a subject comprising; deploying an aerosol generating device a first heating element, a second heating element, a first compartment for containment of vaporizable material, and a second compartment for containment of vaporizable material, wherein the vaporizable material in the first compartment is the same or different as the vaporizable material in the second compartment; and heating the vaporizable materials with at least one heating element of the device to a target temperature to generate an aerosol; and delivering the aerosol to the subject for inhalation.

In some embodiments of the method, the aerosol comprises particles less than about 2 microns in diameter.

Provided herein is a device for generating an aerosol from a vaporizable material wherein the aerosol contains at least 70% less Hoffman analytes than a substance generated by burning a tobacco material.

Provided herein is a device for generating an aerosol from a vaporizable material wherein the device generates an aerosol from a vaporizable material wherein the vapor generated by the device yields a non-mutagenic Ames test result.

Provided herein is a device for generating an aerosol from a vaporizable material wherein the aerosol vapor scores significantly better on the Ames test than a substance generated by burning a tobacco material.

Provided herein is a device for generating an aerosol from a vaporizable material wherein the device provides an aerosol for inhalation to a user for at least three non-continuous hours without servicing the device.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. An apparatus for generating an inhalable aerosol, the apparatus comprising:

a first compartment configured to store a first vaporizable material, the first compartment comprising a first atomization chamber configured to be in fluid communication with the first vaporizable material, wherein the first atomization chamber defines a first portion of an airflow path;

a first heating element configured to vaporize the first vaporizable material to form a first vapor;

a second compartment positioned upstream of the first compartment and configured to store a second vaporizable material, the second compartment comprising a second atomization chamber configured to be in fluid communication with the second vaporizable material, wherein the second atomization chamber defines a second portion of the airflow path; and a second heating element configured to vaporize the second vaporizable material to form a second vapor that mixes with the first vapor present in the second atomization chamber.

2. The apparatus of claim 1, wherein at least one of the first compartment and the second compartment are removable from the apparatus.

3. The apparatus of claim 1, further comprising the first vaporizable material and the second vaporizable material, wherein at least one of the first vaporizable material and the second vaporizable material comprise a gel.

4. The apparatus of claim 1, further comprising a wicking material configured to be in fluid communication with the first vaporizable material, wherein the first heating element is in contact with the wicking material.

5. The apparatus of claim 1, further comprising a wicking material configured to be in fluid communication with the second vaporizable material, wherein the second heating element is in contact with the wicking material.

6. The apparatus of claim 1, wherein the first heating element is configured to heat the first vaporizable material to a first target temperature, and wherein the second heating element is configured to heat the second vaporizable material to a second target temperature that is different than the first target temperature.

7. The apparatus of claim 6, wherein the first target temperature is from about 250° C. to about 300° C.

8. The apparatus of claim 6, wherein the second target temperature is greater than 250° C.

9. The apparatus of claim 6, wherein the first vaporizable material comprises nicotine, wherein the first target temperature is between about 100° C. and about 190° C.

10. The apparatus of claim 9, wherein the second vaporizable material comprises humectants, and wherein the second target temperature is between about 100° C. and about 210° C.

11. The apparatus of claim 9, wherein the second vaporizable material comprises flavorants, and wherein the second target temperature is between about 100° C. and about 170° C.

12. The apparatus of claim 1, further comprising a body, the body comprising:

a battery, and circuitry configured to selectively activate the first heating element to heat the first vaporizable material and to selectively activate the second heating element to heat the second vaporizable material.

13. The apparatus of claim 1, further comprising a cartridge, wherein the first compartment and the second compartment are positioned within the cartridge, and wherein the cartridge comprises a mating end configured to detachably couple to a body comprising a battery housed therein, the mating end comprising:

a first plurality of contacts electrically coupled to the first heating element, and a second plurality of contacts electrically coupled to the second heating element.

14. An apparatus for generating an inhalable aerosol, the apparatus comprising:

a cartridge having a first end and a second end and a longitudinal axis extending therebetween, the cartridge comprising, an airflow path extending along the longitudinal axis of the cartridge;

a first compartment configured to store a first vaporizable material, the first compartment comprising a first airflow path, the first compartment comprising a first chamber comprising the first airflow path;

a first heating element configured to vaporize the first vaporizable material to form a first vapor;

a second compartment configured to store a second vaporizable material, the second compartment comprising a second airflow path that is in communication with the first airflow path, the second compartment comprising a second chamber comprising the second airflow path; and a second heating element configured to vaporize the second vaporizable material to form a second vapor, the second vapor introduced to the first vapor in the second chamber;

wherein the first and second compartments are positioned in series relative to the airflow path.

15. The apparatus of claim 14, further comprising the first vaporizable material and the second vaporizable material, wherein at least one of the first vaporizable material and the second vaporizable material comprise a gel.

16. The apparatus of claim 14, wherein at least one of the first compartment and the second compartment are removable from the apparatus.

17. The apparatus of claim 14, further comprising a wicking material configured to be in fluid communication with the first vaporizable material, wherein the first heating element is in contact with the wicking material.

18. The apparatus of claim 14, further comprising a wicking material configured to be in fluid communication with the second vaporizable material, wherein the second heating element is in contact with the wicking material.

19. The apparatus of claim 14, wherein the first heating element is configured to heat the first vaporizable material to a first target temperature, and wherein the second heating element is configured to heat the second vaporizable material to a second target temperature that is different than the first target temperature.

20. The apparatus of claim 14, further comprising a cartridge, wherein the first compartment and the second compartment are positioned within the cartridge.

21. The apparatus of claim 14, further comprising a body, the body comprising:

a battery, and circuitry configured to selectively activate the first heating element to heat the first vaporizable material and to selectively activate the second heating element to heat the second vaporizable material.

22. The apparatus of claim 14, further comprising a first capacitive sensing zone and a second capacitive sensing zone, wherein the first capacitive sensing zone is electrically isolated from the second capacitive sensing zone, and wherein the first and second capacitive sensing zones are configured so that when a user swipes a finger from the first capacitive sensing zone to the second capacitive sensing zone, or from the second capacitive sensing zone to the first capacitive sensing zone, the apparatus communicates information to the user, the information comprising, a battery charge level, a vaporizable material level, a pre-heat state, or a combination thereof.

23. The apparatus of claim 14, further comprising a first capacitive sensing zone and a second capacitive sensing zone, wherein the first capacitive sensing zone is electrically isolated from the second capacitive sensing zone, and wherein the first and second capacitive sensing zones are configured so that when a user swipes a finger from the first capacitive sensing zone to the second capacitive sensing zone or from the second capacitive sensing zone to the first capacitive sensing zone, the apparatus is activated.

* * * * *